US010889942B2

(12) United States Patent
Frelich

(10) Patent No.: US 10,889,942 B2
(45) Date of Patent: Jan. 12, 2021

(54) METHOD AND SYSTEM FOR POSITIONING SCREED PLATES

(71) Applicant: Caterpillar Paving Products Inc., Brooklyn Park, MN (US)

(72) Inventor: Toby A. Frelich, Saint Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/424,057

(22) Filed: May 28, 2019

(65) Prior Publication Data

US 2020/0378074 A1 Dec. 3, 2020

(51) Int. Cl.
*E01C 19/42* (2006.01)
*E01C 19/48* (2006.01)

(52) U.S. Cl.
CPC ..... *E01C 19/42* (2013.01); *E01C 19/4873* (2013.01)

(58) Field of Classification Search
CPC ..... E01C 19/42; E01C 19/4873
USPC ..... 404/72, 75, 84.05–84.5, 118
See application file for complete search history.

(56) References Cited

U.S. PATENT DOCUMENTS 3,604,512 A 9/1971 Carter et al.
3,872,601 A * 3/1975 Burgin ..... E01C 19/4873 200/61.45 R
4,925,340 A * 5/1990 Heiser ..... E01C 19/004 404/118
5,356,238 A * 10/1994 Musil ..... E01C 19/008 404/101
6,129,481 A 10/2000 Tapio et al.
6,530,720 B1 3/2003 Green
7,144,191 B2 * 12/2006 Kieranen ..... E01C 19/006 404/84.1
8,033,751 B2 10/2011 Yost
8,152,409 B1 * 4/2012 Ligman ..... E01C 19/006 404/118
9,279,679 B2 3/2016 Kumagai et al.
9,447,552 B2 9/2016 Buschmann et al.
9,534,348 B2 1/2017 Rio et al.
9,835,610 B2 12/2017 Kangas
2010/0183369 A1 * 7/2010 Lindley ..... G01C 15/006 404/84.5
2010/0215733 A1 * 8/2010 Alon ..... A61K 9/48 424/451
2014/0363230 A1 * 12/2014 Buschmann ..... E01C 19/002 404/72

(Continued)

*Primary Examiner* — Raymond W Addie
(74) *Attorney, Agent, or Firm* — Schwegman, Lundberg & Woessner

(57) ABSTRACT

A system for a screed assembly of a paving machine can include a plurality of screed plates, a screed frame, a first plurality of sensors, a second plurality of sensors, a device and a controller. The device can be configured to create a physical phenomenon that is detectable by the first plurality and the second plurality of sensors. The controller can be configured to, based on a detected position of each of the rust plurality of sensors and each of the second plurality of sensors relative to the physical phenomenon, determine a relative position between the first screed plate and the second screed plate including a degree of parallelism between the major surface of the first screed plate and the major surface of the second screed plate.

20 Claims, 3 Drawing Sheets

(56) References Cited

U.S. PATENT DOCUMENTS

| | | | | |
|---|---|---|---|---|
| 2015/0063907 | A1* | 3/2015 | Graham | E01C 19/48<br>404/84.1 |
| 2017/0030030 | A1* | 2/2017 | Frelich | E01C 19/46 |

* cited by examiner

METHOD AND SYSTEM FOR POSITIONING SCREED PLATES

TECHNICAL FIELD

The present application relates generally to apparatuses, methods and systems that enable a first screed plate for a working machine to be positioned as desired relative to one or more other screed plates of the working machine.

BACKGROUND

Pavers or paving machines are working machines used in an asphalt paving process to create a new road surface. Such pavers assist in pouring and spreading paving material to form a new roadway surface or mat. With asphalt pavers, an aggregate filled bituminous mixture that comprises the paving material is spread while hot and is then compacted so that a hardened pavement surface is formed upon cooling. Pavers typically utilize a heavy assembly termed a "screed" that is drawn behind the paving machine. The screed assembly includes a replaceable screed plate to spread a smooth even layer of paving material on the prepared roadbed. The weight and/or a vibration of the screed assembly aids in compressing the paving material and performing initial compaction of the paving material layer.

Typically, asphalt pavers utilize multiple screed plates which comprise different distinct components. Each separate component has a positional relationship with respect to the mat and the other distinct screed plates. U.S. Pat. No. 9,279,679 discusses a control system that utilizes a laser surveying instrument and detector elements. However, the system of the U.S. Pat. No. 9,279,679 is not paver/screed plate specific and relies on the control system to calculate a tilt and tilting direction of the construction machine. U.S. Pat. No. 9,835,610 focuses on a screed machine for concrete having a control system but utilizes elevation sensors and the control system to determine a flatness or levelness or quality of the surface of the concrete being screeded. Thus, neither U.S. Pat. No. 9,279,679 or 9,835,610 are directed to a similar problem or solution as the present application as further discussed in the Industrial Applicability section of this document.

SUMMARY OF THE INVENTION

In one example, a system for a screed assembly of a paving machine is disclosed. The system can include a plurality of screed plates including at least a first screed plate and a second screed plate, a screed frame, a first plurality of sensors, a second plurality of sensors, a device and a controller. The screed frame can be coupled to the paving machine and at least one of first screed plate and the second screed plate. The first plurality of sensors can be mounted to one of the screed frame adjacent the first screed plate or a major surface of the first screed plate. The second plurality of sensors can be mounted to one of the screed frame adjacent the second screed plate or a major surface of the second screed plate. The device can be configured to create a physical phenomenon that is detectable by the first plurality and the second plurality of sensors. The controller can be configured to, based on a detected position of each of the first plurality of sensors and each of the second plurality of sensors relative to the physical phenomenon, determine a relative position between the first screed plate and the second screed plate including a degree of parallelism between the major surface of the first screed plate and the major surface of the second screed plate.

In another example, a method for positioning a first screed plate relative to a second screed plate is disclosed. The method can include positioning a first plurality of sensors on at least one of a major surface of the first screed plate or a screed frame adjacent the first screed plate, positioning a second plurality of sensors on at least one of a major surface of the second screed plate or the screed frame adjacent the second screed plate, operating a device to create a physical phenomenon that is detectable by the first plurality and the second plurality of sensors, and determining a relative position between the first screed plate and the second screed plate including a degree of parallelism between the major surface of the first screed plate and the major surface of the second screed plate based on a detected position of each of the first plurality of sensors and each of the second plurality of sensors relative to the physical phenomenon.

In another example, a paver with a screed positioning system aboard is disclosed. The paver can include a plurality of screed plates including at least a first screed plate and a second screed plate, a first plurality of sensors mounted to a major surface of the first screed plate, a second plurality of sensors mounted to a major surface of the second screed plate, a controller configured to, based on a detected position of each of the first plurality of sensors and each of the second plurality of sensors, determine a relative position between the first screed plate and the second screed plate including a degree of parallelism between the major surface of the first screed plate and the major surface of the second screed plate, and one or more position actuators coupled to at least one of the first screed plate and the second screed plate, wherein the controller is configured to operate the one or more position actuators to change the relative position between the first screed plate and the second screed plate and thereby change the degree of parallelism between the major surface of the first screed plate and the major surface of the second screed plate.

DETAILED DESCRIPTION

Figure 1:
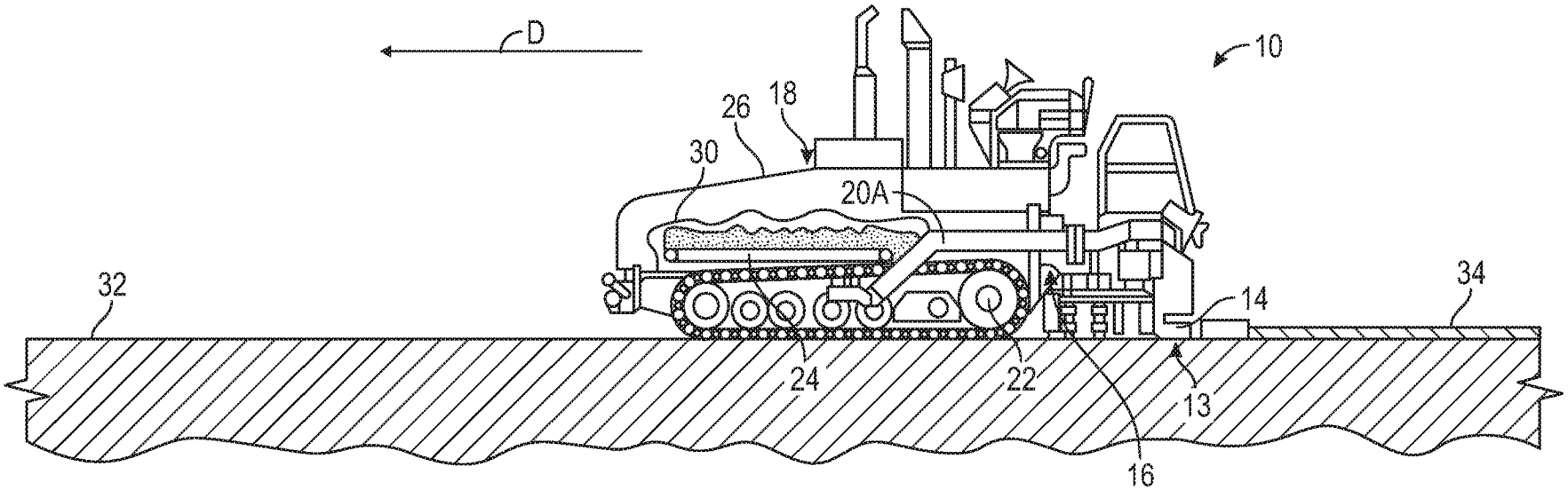
FIG. 1 is a schematic side view of an asphalt paving machine showing a screed assembly according to an example of the present application.

FIG. 1 is a schematic side view of an asphalt paving machine 10 showing a screed assembly 14 positioned rearward of an auger system 16. The asphalt paving machine 10 can comprise a vehicle portion 18, which can be connected to the screed assembly 14 via a tow arm 20A. The paving machine 10 can additionally have a plurality of screed plates 13 that is part of the screed assembly 14. A second tow arm (not shown) can also be provided in some cases. The vehicle portion 18 can additionally comprise a propulsion element 22, a conveyor system 24 and a hopper 26.

Loose paving material 30 can be deposited onto the hopper 26 of the paving machine 10 via a dump truck, elevator or other suitable means. The paving material 30 can be asphalt, aggregate materials or concrete. In various embodiments, the paving material 30 can be deposited into the hopper 26 of the paving machine 10. The paving machine 10 can travel in direction D.

The conveyor system 24 can be disposed within or below the hopper 26. The conveyor 26 can transport the loose paving material 30 through the vehicle portion 18 toward the auger system 16. A grading implement, such as the screed assembly 14, can be attached to the rear of the vehicle portion 18 to receive the paving material 30 from the auger system 16. The screed assembly 14 can be towed by tow arms 20A, only one of which is shown in FIG. 1. The propulsion system 22 can comprise a ground engaging element, such as an endless track as shown in FIG. 1, wheels or the like for propelling the paving machine 10 along the work surface 32. The loose paving material 30 can be deposited by the conveyor system 24 in front of the auger system 16. The auger system 16 can disperse the loose paving material 30 along the width (into the plane of FIG. 1) of the screed assembly 14. The screed assembly 14 can compact the loose paving material 30 into a mat 34 behind the paving machine 10.

More particularly, in order to facilitate formation of the mat 34, the paving machine 10 can be outfitted with the plurality of screed plates 13. The plurality of screed plates 13 can be configured to spread a smooth even layer of the paving material on the prepared roadbed as the mat 34. The weight and/or a vibration of the screed assembly 14 aids in compressing the paving material and performing initial compaction of the paving material layer into the mat 34. To facilitate laying of the paving material 30 as the mat 34, the plurality of screed plates 13 can be heated to a temperature in the range of about 82 to 171° C. (180° to 340° F.). Heating the plurality of screed plates 13 can assist the paving material 30 in flowing under the plurality of screed plates 13 and can reduce adhesion of the paving material 30 to the plurality of screed plates 13.

Figure 2:
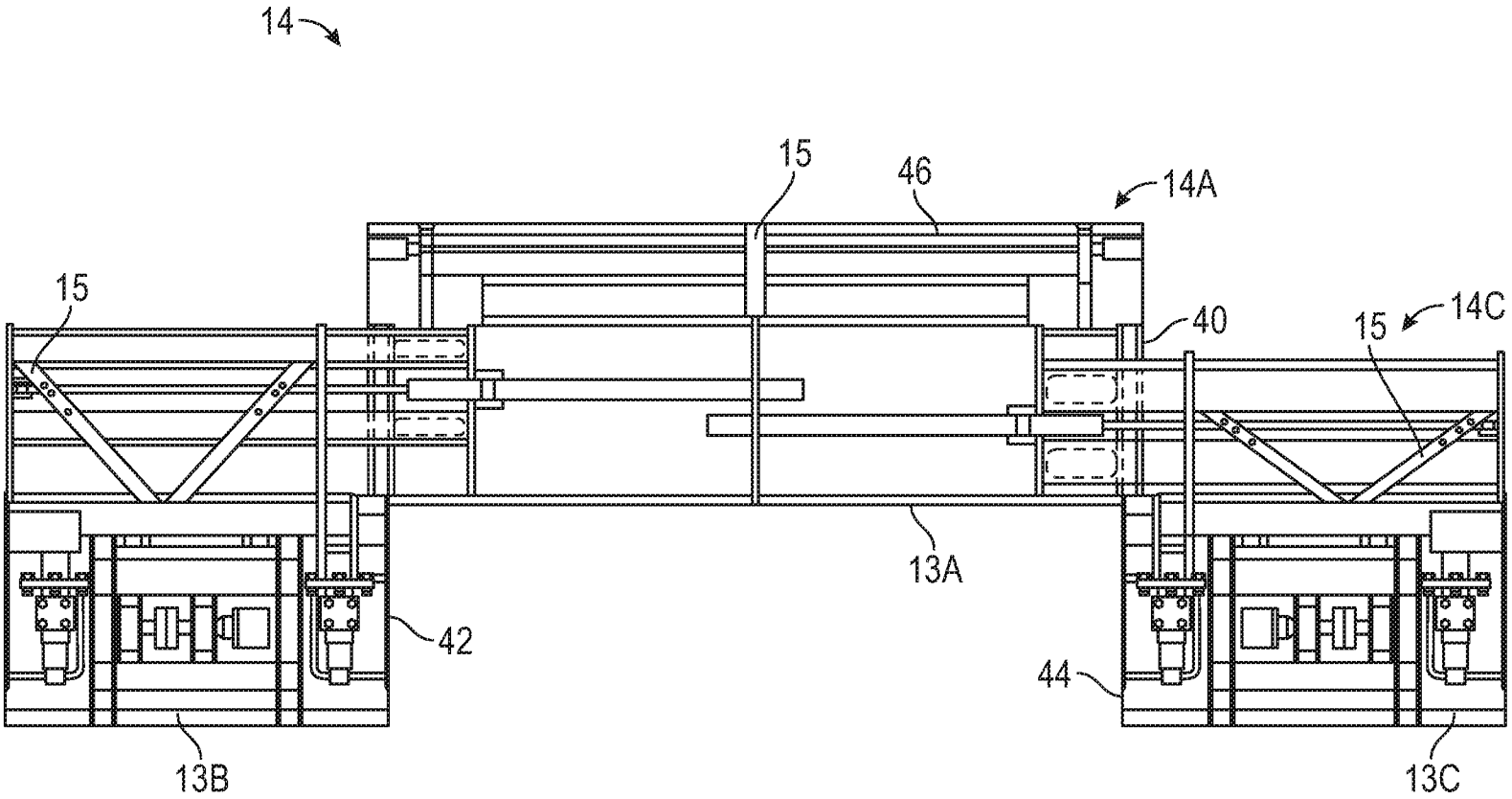
FIG. 2 is a schematic top view of the screed assembly further illustrating a screed frame and a plurality of screed plates according to an example of the present application.

FIG. 2 shows the screed assembly 14 in isolation from the asphalt paving machine 10. As shown in FIG. 2, the screed assembly 14 can typically be separated into several separate sections 14A, 14B and 14C positioned at different positions relative to a cross-directional width of the paving machine 10 (FIG. 1). Separating the screed assembly 14 in this manner can allow for ease of access and removal of components for, installation, maintenance and other purposes. It can also facilitate relative cross-directional movement of the separate portions 14A, 14B and 14C during operation if desired. The screed assembly 14, in particular the screed plates 13, can be coupled back to the paving machine 10 a screed frame 15 (only partially shown in FIG. 2). In some cases, the screed frame 15 can also couple one or more of the separate portions 14A, 14B and 14C together.

Each of the separate sections 14A, 14B and 14C of the screed assembly 14 can each have an associated screed plate. Thus, the plurality of screed plates 13 of the embodiment of FIG. 2 can include a first screed plate 13A, a second screed plate 13B and a third screed plate 13C. However, is contemplated that the screed assembly 14 and the plurality of screed plates 13 can be any of a number of configurations such as a fixed width screed or a multiple section screed that includes extensions.

FIG. 2 shows the screed assembly 14 can have a main screed section 40 and a left and a right screed plate extensions 42, 44. The main screed section 40 can include the screed plate 13A, the left section 42 can include the screed plate 13B and the right screed section 44 can include the screed plate 13C. In some cases, the left and right screed plate extensions 42, 44 can connect to the main screed section 40 so that various operations, such as crowning, can be performed. The left and the right screed plate extensions 42, 44 can be positioned behind and adjacent the main screed section 40, although the left and the right screed plate extensions 42, 44 may be positioned in front of the main screed section 20 in other embodiments. The left and the right screed plate extensions 42, 44 can be slidably or otherwise movable, such as by actuators (not shown), so that varying widths of paving material being laid or performing other tasks (e.g., crowning) is possible. The screed assembly 14 can include a tamper bar 46 positioned forward of the main screed section 40, as shown in 2. In other examples, a vibratory mechanism can be with the main screed section 40 and/or the left and the right screed plate extensions 42, 44 to aid in the initial compaction of the paving material being laid down.

Figure 3:
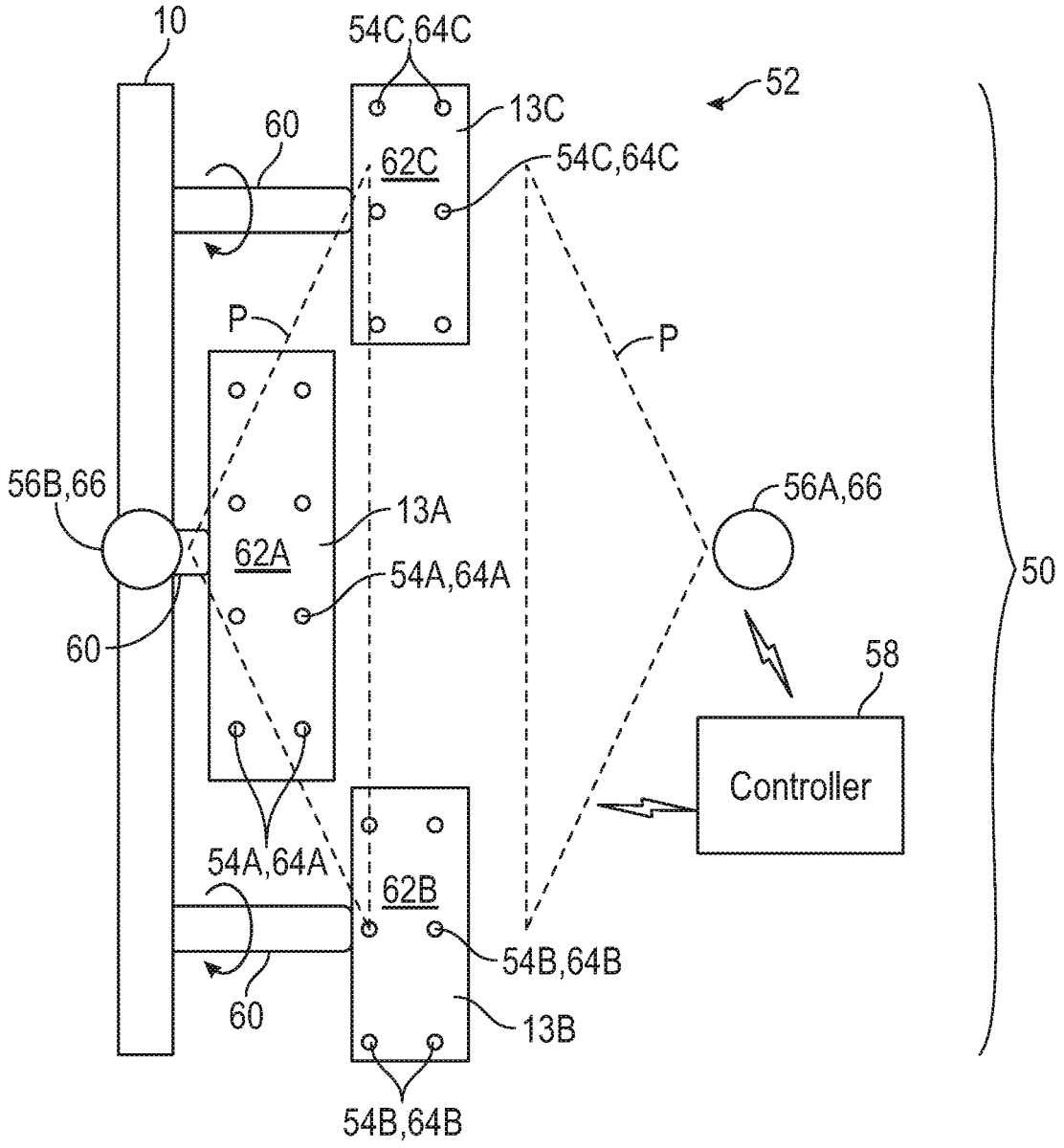
FIG. 3 is a schematic view of a screed positioning system for the plurality of screed plates of FIG. 2.

FIG. 3 shows a system 50 and method 52 whereby a first screed plate (e.g., one of the first screed plate 13A, the second screed plate 13B and the third screed plate 13C) for the asphalt paving machine 10 can positioned as desired relative to one or more other screed plates (e.g., the first screed plate 13A, the second screed plate 13B and the third screed plate 13C) of the asphalt paving machine 10. The system 50 and method 52 can further determine how flat (relative to a horizontal or mat surface) and parallel (relative to other plates) the plates are according to some embodiments. It should be noted that the system 50 and the method 52 described herein can be implemented during the service/maintenance process and/or during operation (for autonomous or on-the-fly adjustments of the screed plates) of the asphalt paving machine 10. Thus, various components of the system 50 may or may not be part of the asphalt paving machine 10 according to various embodiments.

More particularly, FIG. 3 shows the screed assembly 14 with portions removed to illustrate the first screed plate 13A, the second screed plate 13B and the third screed plate 13C and other components of the system 50 in further detail. According to the example of FIG. 3, the system 50 can optionally include the first screed plate 13A, the second screed plate 13B and/or the third screed plate 13C, a first plurality of position referencing elements 54A, a second plurality of position referencing elements 54B, a third plurality of position referencing elements 54C, a device 56A and/or 56B, a controller 58 and one or more actuators 60.

The first plurality of position referencing elements 54A can be positioned on or otherwise mounted to the first screed plate 13A such as on a major surface 62A (i.e. an upper surface or lower surface) thereof. Similarly, the second plurality of position referencing elements 54B can be positioned on or otherwise mounted to the second screed plate 13B such as on a major surface 62B (i.e. an upper surface or lower surface) thereof. The third plurality of position referencing elements 54C can be positioned on or otherwise mounted to the third screed plate 13C such as on a major surface 62C (i.e. an upper surface or lower surface) thereof. According to some examples, the position referencing elements 54A, 54B, 54C can be spaced apart a specific distance and/or can form a desired pattern.

The position referencing elements 54A, 54B, 54C can comprise sensors 64A, 64B, 64C according to some examples. The sensors 64A. 64B, 64C can be at least one of wireless node receivers, optical sensors, acoustic sensors, accelerometers, magnetometers or gyroscopes, for example. However, in other examples the position referencing elements 54A, 54B, 54C can simply be indicia such as objects of a same particular shape and size. In such an example, the device 56A and/or 56B could be an image capture device such as a camera that captures images of the shape and position referencing elements 54A, 54B, 54C. From this image data, the controller 58 can be configured to determine a relative position between the first screed plate and the second screed plate including a degree of parallelism between the major surface 62A of the first screed plate 13A and the major surface 62B of the second screed plate 13B. Depending on application, maintenance or operating, the sensors 64A, 64B, 64C can be placed on top or on bottom of the screed plate 13A, 13B and/or 13C (i.e. on the major surface 62A, 62B and/or 62C thereof). In alternative embodiments, the sensors 64A, 64B and/or 65C can be placed on the screed frame 15 (FIG. 2) rather than the screed plate 13A, 13B and/or 13C itself. In yet further embodiments, the sensors 64A, 64B and/or 65C can be mounted to anything attached to the screed plate 13A, 13B and/or 13C.

The device 56A is optional to the system 50 and can be used, for example when the asphalt paving machine 10 is non-operational such as during service/maintenance. Thus, the device 56A is illustrated behind the asphalt paving machine 10 and behind the first screed plate 13A, the second screed plate 13B and the third screed plate 13C. The device 56A can be mounted to a tripod or another type of stand in this position. Alternatively or additionally, the device 56B can be coupled to the asphalt paving machine 10 such as at the main housing and can be utilized during operation (for autonomous or on-the-fly adjustments of the screed plates) as will be further discussed herein. Thus, in some cases the system 50 including the device 56B and the controller 58 can be mounted to the asphalt paving machine 10. The device 56A, 56B can be configured to create a physical phenomenon P (indicated in dash) such as light or energy that is detectable by the sensors 64A, 64B, 64C. It should be noted that the device 56A, 56B is optional to the system 50 in some embodiments as the sensors 64A, 64B, 64C can be configured to determine relative positions via communicate with one another and/or the controller 58, or other means as known in the art.

According to one embodiment, the device 56A, 56B can comprise an optical transmitter device 66 such as a laser device D22 available from Easy-Laser® (www.easy-laser-.com), for example. The optical transmitter device 66 and the sensors 64A, 64B, 64C can comprise wireless node receivers (also called "smart nodes" herein). Such smart nodes can comprise a two axis PSD E7 detector constructed as further described subsequently and commercially available from Easy-Laser® (www.easy-laser.com), for example. The device 56A, 56B can be configured to sweep light or energy such as a laser beam across and above or below the major surfaces 62A, 62B and 62C of the screed plates 13A, 13B and 13C and into impingement, successively, with all the sensor nodes. Each sensor node can be configured to detect a respective vertical relationship with (i.e. how high or low the center of its sensor face is relative to) a reference plane generated by the laser beam as it sweeps horizontally across the sensor node. Each sensor node can be configured to communicate an individual distance/height reading to the controller 58. The controller 58 can be configured to determine and display a combined output to an operator and/or can determine flatness and parallelism of one or more of the screed plates 13A, 13B and 13C, using the combined altitude (vertical relationship) readings of some or all of the sensor nodes.

Thus, according to one example, the controller 58 can be configured to, based on a detected position of each of the first plurality of sensors 64A and each of the second plurality of sensors 64B relative to the physical phenomenon P, determine a relative position between the first screed plate 13A and the second screed plate 13B including a degree of parallelism between the major surface 62A of the first screed plate 13A and the major surface 62B of the second screed plate 13B. A similar determination can be performed by the controller 58 using each of the first plurality of sensors 64A and the third plurality of sensors 64C position relative to the physical phenomenon P. In such case, the controller 58 can determine a relative position between the first screed plate 13A and the third screed plate 13C including a degree of parallelism between the major surface 62A of the first screed plate 13A and the major surface 62C of the third screed plate 13C.

Returning now to the embodiment using the smart nodes, the controller 58 can be configured to make other determinations from data provided by the smart nodes including a degree of flatness or levelness relative to a horizontal or the screed mat, for example. Thus, the controller 58 can be configured to determine an orientation of at least the first major surface 62A of the first screed plate 13A relative to at least one of a horizontal plane or work surface. The orientation of the other screed plates 13B, 13C can be referenced from the first screed plate 13A, for example. In other examples, the orientation of the second screed plate 13B or the third screed plate 13C could initially be determined and then referenced. In yet further embodiments, the orientation of each screed plate 13A, 13B and 13C can be independently determined. The orientation can be determined, for example, with the device 56B mounted to the asphalt paving machine 10, for example, using the main housing has leveling means (i.e. screws) to establish a perfect (i.e. vertical) swing axis for rotation of the device 56B thereabout. A swiveling head is included on or in the main housing for incorporation of the device 56B to rotate therewith, the laser beam being directed outward (at a right angle to the swing axis). The swiveling head performs a 360 degree (or less) sweep about the swing axis. Each smart node can include an attachment means for affixing on the respective screed plate. A head containing a sensor is directed toward the device 56B (laser source on the main housing) and locked in that orientation. A two-axis sensor, facing the main housing, detects the height of the passing laser beam relative to the smart node altitude each time the beam passes. A Bluetooth or other wireless or wired communication system transmits the height reading to the controller 58. Data from the smart nodes can be displayed to an operator or otherwise (i.e. automatically) acted on using the controller 58. For example, the controller 58 can be configured for controlling autonomous or on-the-fly adjustments of the screed plates 13A, 13B and 13C via the one or more actuators 60.

The one or more actuators 60 can be coupled to at least one (or all) of the first screed plate 13A, the second screed plate 13B and the third screed plate 13C and can also be coupled to or be a part of the asphalt paving machine 10. Such coupling can be at the major surfaces 62A, 62B and/or 62C thereof or side surfaces thereof. The controller 58 can be configured to operate the one or more position actuators 60 to achieve a desired flatness for the screed plates 13A, 13B and 13C, to change the relative position between the first screed plate 13A, the second screed plate 13B and/or the third screed plate 13C, and thereby change the degree of parallelism between the major surfaces 62A, 62B and/or 62C of the screed plates 13A, 13B and 13C, etc. Although FIG. 3 shows the one or more actuators 60 as providing rotating movement to rotate the screed plates 13A, 13B and 13C it is also contemplated that the one or more actuators 60 can provide for linear adjustment of the screed plates 13A, 13B and 13C (e.g. to move one or more of them toward or away from the mat (ground), for example.

The controller 58 can comprise embedded or integrated controller(s) that are part of the paving machine 10, for example. The controller 58 can comprise one or more processors, microprocessors, microcontrollers, electronic control modules (ECMs), electronic control units (ECUs), or any other suitable means for electronically controlling one or more functions of the paving machine 10.

The controller 58 can be configured to operate according to a predetermined algorithm or set of instructions for making the determinations discussed herein regarding positioning of one or more of the screed plates 13A, 13B and 13C including determining a degree of parallelism between the screed plates 13A, 13B and/or 13C and controlling the one or more actuators 60 as discussed herein. In making such determinations, the controller 58 can use data based on, for example, input from one or all of the sensors 64A, 64B, 64C, the device 56A, 56B and/or other sources (e.g., operator input, etc.).

It is further contemplated that the controller 58 can be configured to continuously perform various determination discussed herein during operation in a dynamic manner in real-time and output these to an interface and/or make dynamic adjustments to the positioning of the screed plates 13A, 13B and/or 13C. The controller 58 can also be configured to perform the various determinations for discrete periods of predefined time and can output these to the interface or to another remote computer or device in the form of a report, for example.

Such algorithms or set of instructions can be stored in a database and can be read into an on-board memory of the controller 58, or preprogrammed onto a storage medium or memory accessible by the controller 58, for example, in the form of a hard drive, jump drive, optical medium, random access memory (RAM), read-only memory (ROM), or any other suitable computer readable storage medium commonly used in the art (each referred to as a "database").

The controller 58 can be in electrical communication or connected to the sensors 64A, 64B, 64C and various other components, systems or sub-systems of paving machine 10. By way of such connection, the controller 58 can receive data pertaining to the current positions (orientation, degree of parallelism) of the paving machine 10 from sensors 64A, 64B, and/or 64C. In response to such input, the controller 58 may perform various determinations and transmit output signals corresponding to the results of such determinations or corresponding to actions that need to be performed, such as reorienting the screed plates 13A, 13B and/or 13C and alerting the operator as desired. Thus, the controller 58 can be configured to activate the one or more actuators 60 to maintain a desired attitude of one or more of the screed plates 13A, 13B and/or 13C relative to one another and/or a surface of the working area or a horizontal plane, for example.

The controller 58 can include various output devices, such as screens, video displays, monitors and the like that can be used to display information, warnings, data, such as text, numbers, graphics, icons and the like, regarding the status of the system 50. The controller 58 can additionally include a plurality of input interfaces for receiving information and command signals from the operator. Suitably programmed, the controller 100 can serve many additional similar or wholly disparate functions as is well-known in the art.

INDUSTRIAL APPLICABILITY

Example machines in accordance with this disclosure can be used in a variety of industrial, construction, commercial or other applications including paving. Such machines can have the screed assembly 14 including multiple screed plates 13 as discussed herein.

As discussed herein, the system 50 and method 52 enable automated, repeatable, and a more accurate determination of one or more of how flat and how parallel the various screed plates are on the asphalt paving machine 10, before or during use thereof.

An electronic measurement system 50 and methodology is proposed herein to resolve the inherent issues of the prior practice. Prior practice was to periodically check the flatness and parallelism of the screed plates using a series of string lines, straightedges, and/or levels. Not only were these practices and tools cumbersome and timing consuming, but frequently they could result in error due to operator inexperience or lack of precision. As such, the present application proposes, according to one embodiment, the system 50 using a first plurality of sensors 64A mounted to the major surface 62A of the first screed plate 13A and the second plurality of sensors 64B mounted to the major surface 62B of the second screed plate 13B. The system 50 includes the device 56A, 56B configured to create the physical phenomenon that is detectable by the first plurality and the second plurality of sensors 64A, 64B. The system 50 also includes the controller 58 configured to, based on a detected position of each of the first plurality of sensors 64A and each of the second plurality of sensors 64B relative to the physical phenomenon, determine a relative position between the first screed plate 13A and the second screed plate 13B including a degree of parallelism between the major surface 62A of the first screed plate 13A and the major surface 62B of the second screed plate 13B. The controller 58 can be configured to perform other determinations and actions as discussed herein such as determining a degree of flatness (also termed orientation or attitude herein) of one or more of the screed plates 13A, 13B and 13C. Once interpreted through the controller 58, the operator can easily understand one or more of the flatness and parallelism of the screed plates 13A, 13B and 13C and make adjustments that fit the specific needs of the application. Real time feedback from the controller 58 will inform the operator when the specifications are met allowing them to quickly and accurately set the screed for optimal paving results. In addition, the system 50 can be applied to an automated screed wherein the measurement and adjustment can be automatically made while in operation (paving) based on the operator's inputs or based on other factors like active feedback of the paving mat to correct identified defects.

The above detailed description is intended to be illustrative, and not restrictive. The scope of the disclosure should, therefore, be determined with references to the appended claims, along with the full scope of equivalents to which such claims are entitled. The claims should be considered part of the specification for support purposes.

What is claimed is:

1. A system for a screed assembly of a paving machine, comprising:

a plurality of screed plates including at least a first screed plate and a second screed plate;

a screed frame coupled to the paving machine and at least one of first screed plate and the second screed plate;

a first plurality of sensors mounted to a major surface of the first screed plate;

a second plurality of sensors mounted to a major surface of the second screed plate;

a device configured to create a physical phenomenon that is detectable by the first plurality and the second plurality of sensors; and a controller configured to, based on a detected position of each of the first plurality of sensors and each of the second plurality of sensors relative to the physical phenomenon, determine a relative position between the first screed plate and the second screed plate including a degree of parallelism between the major surface of the first screed plate and the major surface of the second screed plate.

2. The system of claim 1, wherein each of the first plurality of sensors and each of the second plurality of sensors is configured to individually determine a position relative to the physical phenomenon created by the device and communicate such position to the controller.

3. The system of claim 1, wherein the first plurality of sensors and the second plurality of sensors comprise at least one of wireless node receivers, optical sensors, acoustic sensors, accelerometers, magnetometers or gyroscopes.

4. The system of claim 1, wherein the device comprises a light emitting transmitter configured to create a reference plane of light relative to the first plurality and the second plurality of sensors, and wherein the detected position of each of the first plurality and each of the second plurality of sensors is relative to the reference plane of light.

5. The system of claim 1, wherein the controller is configured to determine an orientation of at least the first major surface of the first screed plate relative to at least one of a horizontal plane or work surface based on the detected position of each of the first plurality of sensors.

6. The system of claim 1, wherein the device and the controller are mounted to the paving machine.

7. The system of claim 6, further comprising one or more position actuators coupled to at least one of the first screed plate and the second screed plate, wherein the controller is configured to operate the one or more position actuators to change the relative position between the first screed plate and the second screed plate and thereby change the degree of parallelism between the major surface of the first screed plate and the major surface of the second screed plate.

8. A method for positioning a first screed plate relative to a second screed plate, comprising:

positioning a first plurality of sensors on a major surface of the first screed plate or a screed frame adjacent the first screed plate;

positioning a second plurality of sensors on a major surface of the second screed plate or the screed frame adjacent the second screed plate;

operating a device to create a physical phenomenon that is detectable by the first plurality and the second plurality of sensors; and determining a relative position between the first screed plate and the second screed plate including a degree of parallelism between the major surface of the first screed plate and the major surface of the second screed plate based on a detected position of each of the first plurality of sensors and each of the second plurality of sensors relative to the physical phenomenon.

9. The method of claim 8, wherein determining the relative position includes wherein each of the first plurality of sensors and each of the second plurality of sensors is configured to individually determine a position relative to the physical phenomenon and communicating such position.

10. The method of claim 8, wherein operating the device to create the physical phenomenon comprises operating a light emitting transmitter to create a reference plane of light relative to the first plurality and second plurality of sensors, and wherein determining the relative position includes determining the detected position of each of the first plurality and each of the second plurality of sensors relative to the reference plane of light.

11. The method of claim 8, further comprising determining an orientation of at least the first major surface of the first screed plate relative to at least one of a horizontal plane or work surface based on the detected position of each of the first plurality of sensors.

12. The method of claim 8, further comprising automatically altering the relative position between the first screed plate and the second screed plate to change the degree of parallelism between the major surface of the first screed plate and the major surface of the second screed plate based upon the determining the relative position between the first screed plate and the second screed plate.

13. The method of claim 8, further comprising:

positioning a third plurality of sensors on a major surface of a third screed plate; and sequent to determining the relative position between the first screed plate and the second screed plate, determining a relative position between the third screed plate and one of the first screed plate and the second screed plate including a degree of parallelism between the major surface of the third screed plate and one of the major surface of the first screed plate and the major surface of the second screed plate based on a detected position of each of the third plurality of sensors relative to the physical phenomenon.

14. A paver with a screed positioning system aboard comprising:

a plurality of screed plates including at least a first screed plate and a second screed plate;

a first plurality of sensors mounted to a major surface of the first screed plate;

a second plurality of sensors mounted to a major surface of the second screed plate;

a device mounted to the paver and configured to create a physical phenomenon that is detectable by the first plurality and the second plurality of sensors;

a controller configured to, based on a detected position of each of the first plurality of sensors and each of the second plurality of sensors, determine a relative position between the first screed plate and the second screed plate including a degree of parallelism between the major surface of the first screed plate and the major surface of the second screed plate; and one or more position actuators coupled to at least one of the first screed plate and the second screed plate, wherein the controller is configured to operate the one or more position actuators to change the relative position between the first screed plate and the second screed plate and thereby change the degree of parallelism between the major surface of the first screed plate and the major surface of the second screed plate.

15. The paver of claim 14, wherein the first plurality of sensors and the second plurality of sensors comprise at least one of wireless node receivers, optical sensors, acoustic sensors, accelerometers, magnetometers or gyroscopes.

16. The paver of claim 14, wherein the device comprises a light emitting transmitter configured to create a reference plane of light relative to the first plurality and second plurality of sensors, and wherein the detected position of each of the first plurality and each of the second plurality of sensors is relative to the reference plane of light.

17. The paver of claim 14, further comprising a third screed plate and a third plurality of sensors mounted on a major surface of the third screed plate, wherein the controller is configured to determine a relative position between the third screed plate and one of the first screed plate and the second screed plate including a degree of parallelism between the major surface of the third screed plate and one of the major surface of the first screed plate and the major surface of the second screed plate based on a detected position of each of the third plurality of sensors.

18. The paver of claim 14, wherein the controller is configured to determine an orientation of at least the first major surface of the first screed plate relative to at least one of a horizontal plane or work surface based on the detected position of each of the first plurality of sensors.

19. The paver of claim 14, wherein each of the first plurality of sensors and each of the second plurality of sensors is configured to individually determine a position relative to the physical phenomenon created by the device and communicate such position to the controller.

20. The paver of claim 19, wherein the device and the controller are mounted to the paving machine.

* * * * *